US005682859A

United States Patent [19]

Wakeman

[11] Patent Number: 5,682,859

[45] Date of Patent: Nov. 4, 1997

[54] METHOD AND ARRANGEMENT FOR MOUNTING FUEL RAILS

[75] Inventor: Russell J. Wakeman, Canton, Mich.

[73] Assignee: Siemens Automotive Corporation, Auburn Hills, Mich.

[21] Appl. No.: 589,237

[22] Filed: Jan. 22, 1996

[51] Int. Cl.[6] ..... F02M 37/04

[52] U.S. Cl. ..... 123/470; 123/531; 277/18

[58] Field of Search ..... 123/531, 533, 123/470, 472, 52 M; 277/18, 75

[56] References Cited

U.S. PATENT DOCUMENTS

| | | | |
|---|---|---|---|
| 4,240,385 | 12/1980 | Kulke | 123/470 |
| 4,516,555 | 5/1985 | Shioya | 123/470 |
| 4,861,044 | 8/1989 | Jay | 277/75 |
| 4,924,834 | 5/1990 | Bonfiglioli et al. | 123/470 |
| 5,009,212 | 4/1991 | Bishai | 123/531 |
| 5,054,456 | 10/1991 | Rush | 123/531 |
| 5,101,800 | 4/1992 | Schumann | 123/531 |
| 5,465,699 | 11/1995 | Voigt | 123/470 |
| 5,538,258 | 7/1996 | Hager | 277/18 |

*Primary Examiner*—Carl S. Miller
*Attorney, Agent, or Firm*—Russel C. Wells

[57] ABSTRACT

A mounting arrangement and method for installing fuel injectors into a molded composite intake manifold having an integral fuel rail provides an aligned injector pocket bore in the fuel rail portion and an injector seat bore in an intake manifold runner. The seating bore is oversized to allow the injector to be angled to enable the tip to be advanced into the seat bore, allowing the injector one end to be thereafter swung into alignment with the pocket bore and inserted therein. A seal has an integral tubular portion configured to be fit over the injector tip and within the injector seat bore to be located therein. When the manifold is assembled onto the cylinder head, the seal is squeezed to grip the injector tip and sealed within the injector seat bore.

8 Claims, 3 Drawing Sheets

METHOD AND ARRANGEMENT FOR MOUNTING FUEL RAILS

BACKGROUND OF THE INVENTION

This invention concerns mounting of fuel injectors in internal combustion engines.

Modern automotive engines utilize fuel injectors for precisely controlled injection of atomized fuel charges into each engine cylinder for each combustion cycle. The fuel injectors are elongated, generally cylindrical devices which are each received into a respective one of a series of bores formed along a fuel rail, with an internal passage communicating with the interior of the fuel rail in order to be supplied with fuel under pressure. The fuel is pumped into the interior of the fuel rail to supply a plurality of injectors sealed in the bores arranged along the length of the fuel rail.

In one mounting arrangement, the tip of each injector is seated in an intake manifold bore aligned with the fuel rail bore, to be positioned to spray a charge of fuel into the associated engine cylinder. The injector is operated electronically to open a valve included in the injector to allow a metered volume of fuel to be sprayed out of the fuel injector tip.

Fuel rails have in the past been constructed of metal tubes attached to the intake manifold, itself typically constructed of cast aluminum.

Modern designs have begun to provide intake manifolds molded from composite plastics such as glass-filled nylon.

This results in a lighter weight intake manifold. If the fuel rail were integrally molded as a part of the intake manifold, the attachment hardware and assembly required could be dispensed with to lower costs.

However, the necessity of seating the injectors in axially opposing pockets and seats formed into the fuel rail and intake manifold respectively has heretofore precluded such a design where the injectors are mounted in opposed bores in the fuel rail and manifold runners, respectively.

U.S. Pat. No. 5,465,699 issued on Nov. 14, 1995 for an "Intake Pipe Arrangement for an Internal Combustion Engine Having Individual Arc-Shaped Cylinder Intake Pipes" describes an arrangement for mounting fuel injectors to an intake manifold having integral fuel rails, but that arrangement requires a separate intermediate flange and assembly of the intermediate flange to the manifold flange. This increases the cost of the installation, although allowing the assembly of the manifold with the fuel injector prior to mounting of the manifold to the cylinder head.

It is the object of the present invention to provide an arrangement and method for mounting fuel injectors in an intake manifold having an integrated fuel rail which does not require additional separate parts and hardware.

SUMMARY OF THE INVENTION

This object is achieved by a fuel injector mounting arrangement and method including an oversized fuel injector seat bore formed in each intake manifold runner, allowing the fuel injector to be tilted to allow it to be advanced through the manifold seat bore until the upper end of the injector can be rotated to be aligned beneath its associated fuel rail bore.

A special manifold cylinder head seal is provided which has portions fit around the intake manifold opening as with conventional seals, but which is formed with an angled tubular projection located to extend into the oversized fuel injector seat when the seal is installed.

The tubular seal projection is fit over the fuel injector tip, locating it within the seat. A shoulder on the fuel injector tip abuts the end face of the protrusion for axial location and retention of the fuel injector in its pocket.

The fuel rail intake manifold with its complement of fuel injectors can then be installed onto the engine cylinder head as a single assembly, the seal being compressed as the manifold is bolted against the cylinder block mounting surface. The tubular portion is squeezed within the injector seat bore and onto the injector tip as the seal is compressed, sealing both surfaces.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
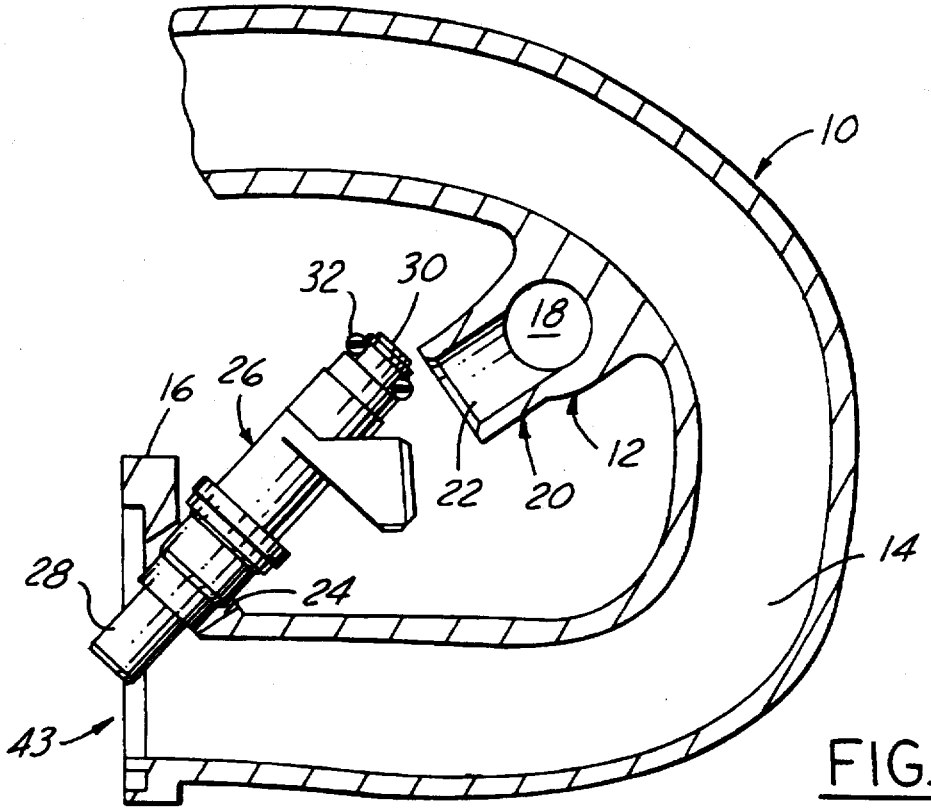
FIG. 1 is a fragmentary sectional view taken through an integral intake manifold and fuel rail, showing a fuel injector tilted to be inserted in an oversized manifold injector seat.

Referring to FIG. 1, a portion of a molded composite intake manifold 10 is shown, which has an integral fuel rail 12 formed therein. The intake manifold 10 has a plurality of runners 14, one for each engine cylinder, one of the runners 14 shown, which has a mounting flange 16 for assembly to the cylinder head of the engine (not shown in FIG. 1).

The fuel rail 12 defines a flow passage 18 which receives a flow of fuel under pressure from the fuel tank during engine operation in the well known manner.

The fuel rail 12 includes a series of protuberances 20 projecting towards a respective manifold runner 14 formed with an open bore 22, defining an injector receiving pocket.

The intake manifold runner 14 is itself formed with a boss having formed therein an oversized bore 24 aligned with the fuel rail pocket bore 22, but axially spaced apart a distance substantially shorter than the overall length of a fuel injector 26 to be installed.

Figure 2:
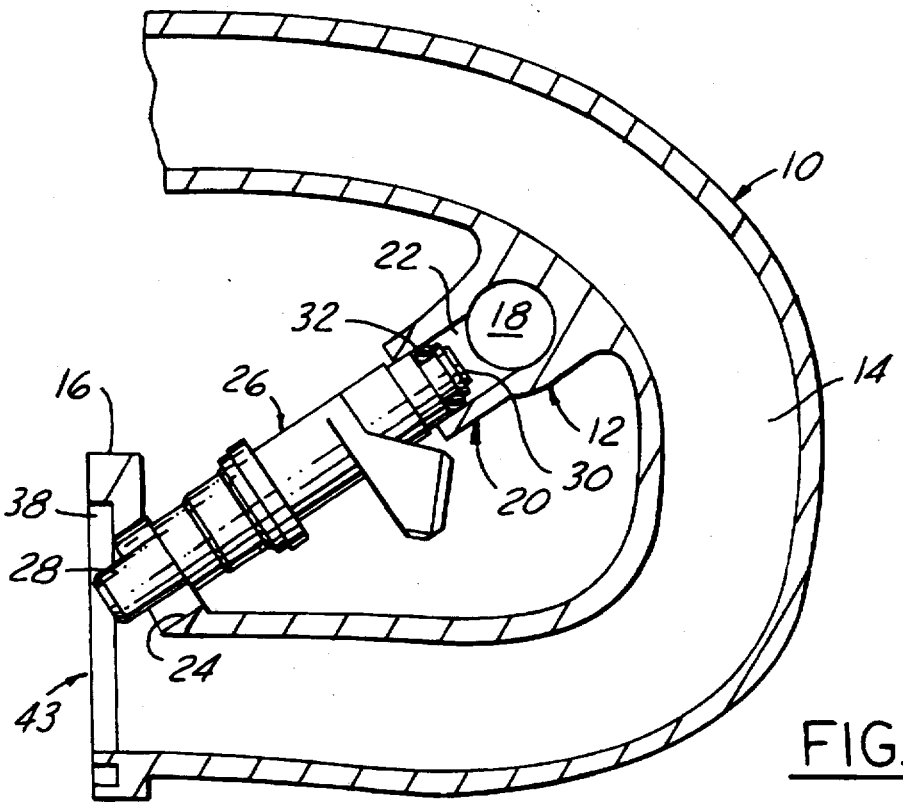
FIG. 2 is a fragmentary sectional view of an intake manifold and integral fuel rail showing the fuel injector inserted in the fuel rail pocket and loosely guided in the oversized injector seat.

The oversized bore 24, being of substantially larger diameter than the diameter of the lower end of the fuel injector 26, allows the injector 26 to be tipped or angled as shown so that the injector tip 28 can be inserted into and advanced through the bore 24. Thus, the upper end or inlet end 30 (carrying preassembled O-ring 32) can now clear the protuberance 20 and be swung into alignment with the fuel rail pocket bore 22. This enables the now aligned upper end 30 to be inserted into the fuel rail pocket bore 22, the O-ring 32 compressed to establish a seal as shown in FIG. 2.

Figure 4:
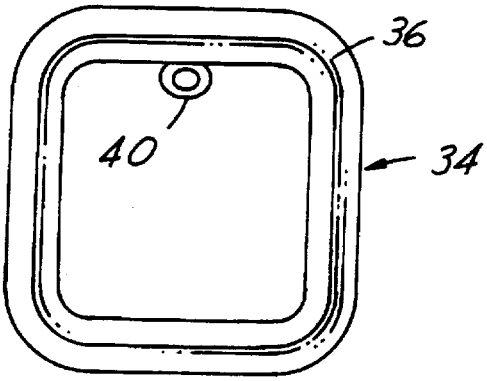
FIG. 4 is a plan view of the seal shown in FIG. 3.
Figure 3:
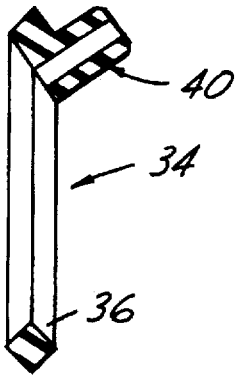
FIG. 3 is a transverse sectional view taken through an intake manifold injector seal.

A manifold runner seal 34 is shown in FIGS. 3 and 4, and includes a main seal portion 36 comprised of a molded ring of an elastomeric material configured to completely encircle the opening at the end of the manifold runner 14, matched to the perimeter configuration of a seal recess 38 in the intake manifold runner flange 16, here shown as a rectangular configuration.

Molded integrally with the main seal portion 36 is an injector locating and sealing tubular portion 40 configured as a tubular projection angled outwardly along an axis inclined to the general plane of the ring formed by the main portion 36 of the seal 34. The inner bore of tubular portion 40 is configured to receive the tip 28 of the injector 26, while the outside diameter thereof is sized to be fit to the injector seat bore 24 in the manifold runner 14.

Thus, the tubular portion 40 can first be inserted into the bore 24, assembled onto the injector tip 28, the inside diameter of the tubular portion 40 being slightly smaller than the outside diameter of the injector tip 28. Suitable chamfering of the surfaces will aid in this process.

Figure 5:
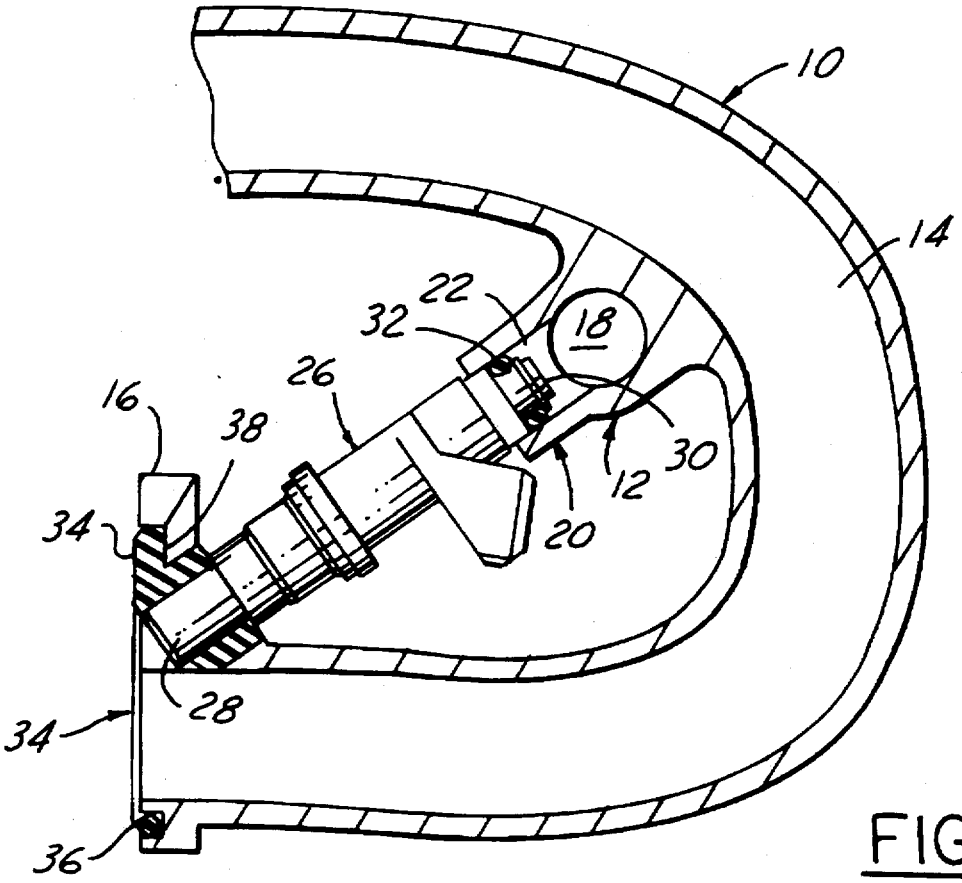
FIG. 5 is a fragmentary sectional view of the molded intake manifold with integral fuel rail having a fuel injector and seal installed.

The main portion 36 is then installed in the recess 38 in runner flange 16 to complete the subassembly. A plurality of runners and injectors require the installation of each of the corresponding seals, to complete the subassembly comprised of the intake manifold fuel rail 10 injectors 26 and seals 34, as shown in FIG. 5.

This subassembly can then be installed on the engine cylinder head 42 of an internal combustion engine 41, an opening 43 in each runner aligned with an intake port 45 in the cylinder head 42, the manifold flanges 16 bolted to the cylinder head surface 44 by threaded bolts or studs (not shown). This compresses the slightly protruding seal 34 to establish sealing between the intake manifold fuel rail 10 and the cylinder head, as well as compressing injector portion 40 between the injector tip outside and the inside of the runner boss bore 24.

The cylinder head surface 44 is disposed in opposition to the inclined wall of the injector seat bore 24 as well as the outside surface of the injector tip 28. Thus, compression of the seal material by the surface 44 creates a squeezing of the seal material against the tip outside surface, as well as the inside surface of the bore 24. This establishes sealing against both surfaces to eliminate the need for a separate injector tip O-ring.

Figure 6:
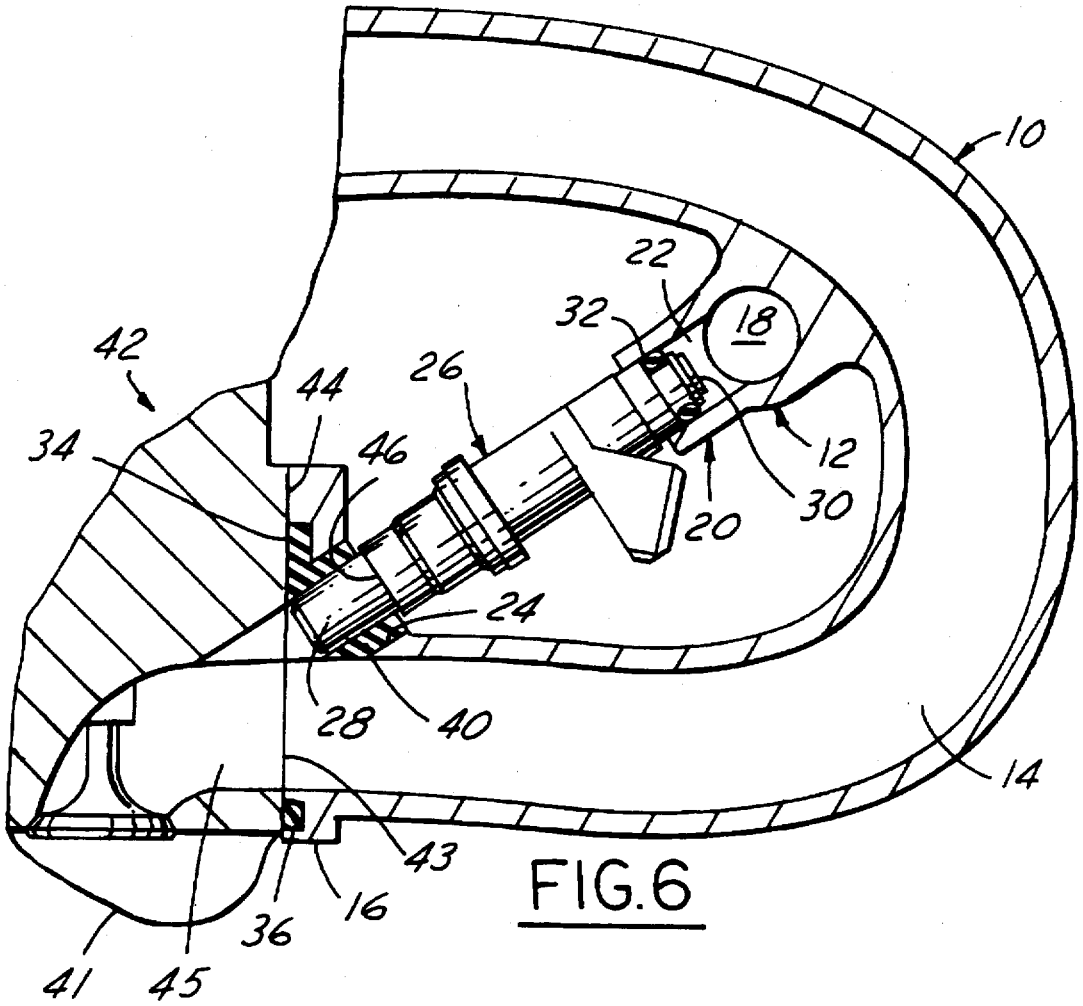
FIG. 6 is a fragmentary sectional view of an engine cylinder head having the intake manifold assembled thereto.

The protruding injector portion 40 locates the associated injector 26 in the oversized bore 24, as well as axially against a shoulder 46 formed on each injector 26, as shown in FIG. 6.

Thus, a greatly simplified installation of the fuel rail and injector results, as the separate fuel rail and attachments are eliminated, as well as clips, etc. used to mount the injectors themselves.

The injectors are securely captured and cannot come loose from the intake manifold assembly.

I claim:

1. A mounting arrangement for fuel injectors for internal combustion engines of the type having an intake manifold having a runner for each fuel injector and an integrally formed fuel rail, said mounting arrangement comprising:

a bore extending into an internal flow passage of said fuel rail portion of said intake manifold providing a Docket for receiving an upper end of said injector:

an aligned injector seat bore formed into an intake manifold runner axially spaced apart therefrom a distance less than a lengthwise dimension of said fuel injector, a diameter of said bore substantially oversized with respect to a diameter of the tip of said fuel injector:

an upper end of said fuel injector inserted into said pocket bore of said fuel rail portion, and carrying a seal compressed within said pocket bore to seal said fuel injector end within said pocket bore;

a tubular seal inserted in said injector seat bore and receiving said tip of said fuel injector, said seal sealed to both said fuel injector tip and said injector seat bore;

said runner is formed with an opening adapted to be installed over an intake port in said engine cylinder head; and a seal having a ring portion encircling said opening and interposed between a flange on said runner and a mounting surface of said cylinder head, said seal ring portion integrally formed with said tubular injector seal in said injector seat bore.

2. The mounting arrangement according to claim 1 wherein said ring portion generally defines a plane and said tubular injector tip seal comprises a cylindrical sleeve extending from said ring portion and inclined outwardly from said plane of said ring portion, said sleeve compressed within said seating bore and onto said fuel injector tip by compression of said seal ring portion by installation of said intake manifold runner onto a mounting surface of an engine cylinder head.

3. A mounting arrangement for fuel injectors for internal combustion engines of the type having an intake manifold having a runner for each fuel injector and an integrally formed fuel rail, said mounting arrangement comprising:

a bore extending into an internal flow passage of said fuel rail portion of said intake manifold providing a pocket for receiving an upper end of said injector;

an aligned injector seat bore formed into an intake manifold runner axially spaced apart therefrom a distance less than a lengthwise dimension of said fuel injector, a diameter of said bore substantially oversized with respect to a diameter of the tip of said fuel injector;

said fuel rail portion including a tubular projection having said fuel injector pocket formed therein, said projection extending out towards said fuel injector seat bore in said runner;

an upper end of said fuel injector inserted into said pocket bore of said fuel rail portion, and carrying a seal compressed within said pocket bore to seal said fuel injector end within said pocket bore;

a tubular seal inserted in said injector seat bore and receiving said tip of said fuel injector, said seal sealed to both said fuel injector tip and said injector seat bore; and said fuel rail portion includes a tubular projection having said fuel injector pocket formed therein, said projection extending out towards said fuel injector seat bore in said runner.

4. The mounting arrangement according to claim 3 wherein said fuel injector tip has a shoulder formed thereon located against an end face of said seal tubular portion.

5. A method of assembling elongated generally cylindrical fuel injectors to an intake manifold having an individual runner for each fuel injector, and an integral fuel rail for supplying fuel under pressure to said fuel injectors, said method comprising the steps of:

forming a pocket bore for each injector in said fuel rail portion sized to sealingly receive one end of an injector;

forming an aligned injector seat bore in a respective runner portion aligned with said pocket bore but spaced a distance apart less than the length of said fuel injector, said seat bore being oversized with respect to an injector tip end opposite said one end so as to allow tilting of said injector tip therein;

inserting said injector into said seat bore while angling said injector and advancing the tip thereof thereinto to enable said one end be swung into alignment with said pocket bore;

inserting said one end into said pocket bore;

thereafter installing a seal interfit between said injector tip and said seat bore to locate said injector tip therein: and then compressing said seal so as to squeeze said seal against said injector tip and said seat bore to seal the same against the surfaces thereof.

6. A method of assembling elongated generally cylindrical fuel injectors to an intake manifold having an individual runner for each fuel injector, and an integral fuel rail for supplying fuel under pressure to said fuel injectors, said method comprising the steps of:

forming a pocket bore for each injector in said fuel rail portion sized to sealingly receive one end of an injector:

forming an aligned injector seat bore in a respective runner portion aligned with said pocket bore but spaced a distance apart less than the length of saint fuel injector, said seat bore being oversized with respect to an injector tip end opposite said one end so as to allow tilting of said injector tip therein:

inserting said injector into said seat bore while angling said injector and advancing the tip thereof thereinto to enable said one end be swung into alignment with said pocket bore;

inserting said one end into said pocket bore;

thereafter installing a seal interfit between said injector tip and said seat bore to locate said injector tip therein: and then installing said intake manifold onto a cylinder head surface, including the step of installing a seal ring around an opening in said runner, said seal ring integral with said seal in said seat bore.

7. The method according to claim 6 wherein said seal comprises a tubular portion inclined outwardly from a plane defined by said seal ring, said seating bore having an axis correspondingly inclined with respect to said cylinder head surface.

8. The method according to claim 7 further including the step of installing an O-ring on said injector one end prior to inserting the same into said pocket bore.

* * * * *